United States Patent [19]

Ivanov et al.

[11] Patent Number: 4,463,908

[45] Date of Patent: Aug. 7, 1984

[54] DEVICE FOR CLAMPING THE ADJUSTMENT RING OF A CONE CRUSHER

[75] Inventors: Nikolai A. Ivanov; Boris G. Ivanov; Leonid P. Zagoratsky; Evgeny S. Mitrofanov; Vladimir A. Cherkassky; Georgy A. Finkelshtein; Ilya I. Blekhman; Oleg P. Barzukov, all of Leningrad; Gennady A. Kaljunov; Isaak Y. Khinich, both of Sverdlovsk; Vladimir Y. Turkin, Leningrad, all of U.S.S.R.

[73] Assignee: Vsesojuzny Nauchnoissledovatelsky I Proektny Institut Mekhanicheskoi Obrabotki Poleznykh Iskopaemykh, Leningrad, U.S.S.R.

[21] Appl. No.: 341,983

[22] PCT Filed: May 30, 1980

[86] PCT No.: PCT/SU80/00092

§ 371 Date: Jan. 11, 1982

§ 102(e) Date: Jan. 11, 1982

[87] PCT Pub. No.: WO81/03438

PCT Pub. Date: Dec. 10, 1981

[51] Int. Cl.[3] ..... B02C 2/04

[52] U.S. Cl. ..... 241/207; 241/286

[58] Field of Search ..... 241/207–216, 241/286, 290, 291, 301

[56] References Cited

U.S. PATENT DOCUMENTS 3,759,453 9/1973 Johnson ..... 241/286 X

FOREIGN PATENT DOCUMENTS 2038855 1/1971 France .
1378011 12/1974 United Kingdom .
298377 4/1971 U.S.S.R. .

*Primary Examiner*—Mark Rosenbaum
*Attorney, Agent, or Firm*—McAulay, Fields, Fisher, Goldstein & Nissen

[57] ABSTRACT

A device for clamping the adjustment ring 3 of a cone crusher with respect to a support ring 1 mated therewith by means of threads 2 comprises a check nut 4 and hydraulic cylinders 7 with spring-actuated piston rods 6 whose tips 8 are arranged in a groove 9, one of the surfaces of the groove being formed by a taper recess 5 of the clamping ring 4 and the other surface thereof being formed by the end surface 10 of the support ring 1. The piston rods 6 of the hydraulic cylinders 7 are arranged radially with respect to the axis of the check nut 4.

8 Claims, 3 Drawing Figures

DEVICE FOR CLAMPING THE ADJUSTMENT RING OF A CONE CRUSHER

FIELD OF THE INVENTION

The present invention relates to intermediate and fine cone crushers, and more particularly, to devices for clamping the adjustment ring of a cone crusher.

The present invention can be used to best advantage in the construction, ore mining and dressing industries.

DESCRIPTION OF THE PRIOR ART

The intermediate and fine cone crushers now in use comprise a liner-clad adjustment ring and a liner-clad breaking head arranged therewithin. Formed between the outer surfaces of the liners is a crushing chamber narrowing to the base of the taper liners and terminating, in its bottom portion, with a discharge opening defined by the shortest distance between the outer surfaces of the liners.

The breaking head is mounted on a spherical support secured on the crusher frame. The adjustment ring is thread-jointed with a support ring mounted on the crusher frame. The breaking head has its drive provided with an eccentric or out-of-balance weight vibrator. The liners mounted on the adjustment ring and on the breaking head are shaped as removable taper shells.

As a result of intensive wear of the liners, the discharge opening between their crushing surfaces becomes larger, resulting in a coarser product discharging from the crushing chamber. To stabilize the crushing process, the crusher setting is periodically adjusted, thus bringing it to the initial set value.

To adjust the setting between the cones, the adjustment ring is rotated in the threaded joint whereupon it is clamped with respect to the support ring. Clamping is accomplished with the aid of power means providing a clamping thrust to said threaded joint.

The adjustment ring clamping device is one of the most critical units of a crusher because of high impact loads generated in the crushing chamber.

There is known a device for clamping the adjustment ring of a cone crusher (Cf. USSR Inventor's Certificate No. 298,377, Int.Cl. B02C 2/04, issued Aug. 1, 1969, inventors: Kolesnik G. G. and Pikhalenko I. G.). The device comprises a support ring screw-threaded to the adjustment ring provided with a clamping ring screw-threaded thereon and spaced from the support ring at an end clearance, wedge jacks being installed in the support ring to apply a clamping thrust to the screw-threaded joints of the adjustment ring with the support ring and clamping ring.

In this device, the clamping ring is screw-threaded with the adjustment ring and rests upon the support ring via the wedge jacks placed in annular recesses of the clamping ring and the support ring. The wedge jacks are fashioned as superimposed pairs of oppositely directed wedges and, as the clamping ring is rotated to lock the adjustment ring, the upper wedges, under the action of frictional forces, start slipping against the lower ones and shifting vertically, thereby applying a clamping thrust to the threaded joints of the adjustment ring with the support ring and clamping ring. With the adjustment ring rotated, together with the clamping ring, in the opposite direction, the upper wedges start slipping downward against the inclined surfaces of the lower wedges, which results in the elimination of the upthrust in the threaded joints.

However, the wedge jacks fail to provide a reliable clamping of the adjustment ring in the threads, since vibrations of the adjustment ring, clamping ring, and support ring caused by the crushing blows in the crushing chamber eliminate the force of friction between the wedges, which sets the adjustment ring free to rotate back out, this being followed by possible failure. Moreover, the wedge jacks are difficult to manufacture.

There is also known a device for clamping the adjustment ring of a cone crusher (Cf. French Patent No. 2,038,855, Int. Cl. B02 2/00, patented Jan. 8, 1971, assigned: Barber Green Company, USA). The device is known to comprise a support ring screw-threaded to an adjustment ring, a clamping ring and clamping leverages with double-acting hydraulic cylinders.

In this device, the clamping ring is screw-threaded to the support ring and locked not to rotate with respect to the adjustment ring. Mounted circumferentially on the clamping ring, at equal distances from each other, are thrust levers pivoted to the piston rods of the hydraulic cylinders. The levers are pivoted to rams rigidly connected with the adjustment ring.

As in the above device, clamping the adjustment ring of the device under consideration is carried out by applying a thrust to the threaded joint of the support ring with the adjustment ring and clamping ring. Upon supplying oil under pressure into one of the hydraulic cylinder chambers, the piston rods displace the lever pairs pivoted thereto from an inclined in a vertical position. This results in an increased total length of the levers and increased distance between the movable rams and their supports rigidly secured on the clamping ring. The rams displace the adjustment ring with respect to the clamping ring, which results in their mutual wedging relative to the support ring and ensures the clamp of the adjustment ring.

To release the clamp, oil under pressure is supplied into the other chamber of the hydraulic cylinders, which brings the levers in an inclined position and eliminates the thrust from the rams that, in turn, allow the adjustment ring to move downward by gravity. The taper surfaces of the threads of the support and adjustment rings are out of contact with each other and the upthrust in the joint is eliminated.

However, the device is known not to suit large-size crushers because of its dimensions which are compatible with the units. This stems from a necessity to ensure the strength of a variety of hinges and levers individually, the length of which must be sufficient to provide the proper play of the adjustment ring in the threads. The numerous levers, hinges, and rams complicate the device and make it difficult to manufacture.

Again, this device is not easy to operate. The clamping ring and clamp units secured thereon will rotate together with the adjustment ring when adjusting the crusher setting, which requires recurrent re-arrangement of the oil-supply hoses during the rotation. The rotation force is transferred to the adjustment ring through the rams, which may cause failure of the latter.

Moreover, wear of the threads results in an increased play thereof, that should be balanced, in case of this device, by adjusting the ram length. Attendant personnel should recurrently be present to carry out this maintenance work, which makes it impossible to fully automate a crusher equipped with this device.

Known in the prior art is a cone crusher adjustment ring clamping device (Cf. U.K. Pat. No. 1,378,011, Int.Cl. B02C 2/00, patented Dec. 18, 1974, inventor Louis Wein Jonson). The cone crusher comprises a support ring screw-threaded to an adjustment ring. In this crusher, the adjustment ring clamping device comprises a clamping ring and hydraulic cylinders provided with spring-actuated piston rods, whose tips are seated in a groove, one of the surfaces of which is formed by a taper recess of the clamping ring.

In this arrangement, the clamping ring is screw-threaded to the support ring, rests upon the adjustment ring, and is shaped as a split ring. The hydraulic cylinders are secured on the adjustment ring in a verticality and have their piston rods equipped with taper tips arranged in a wedge groove formed by an inside-faced taper recess of the clamping ring and by a cylindrical recess of the adjustment ring.

A stock of disk springs arranged in the hydraulic cylinders give the piston rods a thrust directed downward. In this case, the piston rods provide, while deepening inside the groove, horizontally directed forces causing the segments of the clamping ring to move radially outward until the clearance in its threaded joint with the support ring is completely eliminated. The force of friction arising in the threads and wedge recess prevents the adjustment ring from casual rotation in the threads.

To release the clamping thrust, oil under pressure is supplied into the hydraulic cylinders. The stock of the springs is therewith compressed and the taper tips of the piston rods move to the upper portion of the groove, ceasing their wedging action upon the clamping and adjustment rings.

However, this device fails to provide thrust in the threaded joint of the adjustment ring with the support ring, since the clamping ring is not capable of shifting vertically to provide the mutual clamping of the parts of the threaded joint. The force of friction developed by the wedge tips of the piston rods on the cylindrical recess of the adjustment ring fails to provide its reliable clamping, since the blows in the crushing chamber can result in a complete elimination of the force of friction, which sets the adjustment ring free to rotate, this leading to a failure. This device is complex in design and difficult in operation. In particular, the necessity for rotation of the adjustment ring together with the hydraulic cylinders secured thereon may cause a deformation of the piston rods contacting with the unevenly rotating clamping ring and requires periodical rearrangement of the hoses supplying oil to the hydraulic cylinders. This prevents the procedure for adjusting the crusher setting from being fully automated, which in turn results in lost time.

SUMMARY OF THE INVENTION

The principal object of the present invention is to provide a device for clamping the adjustment of a cone crusher, wherein the clamping ring and the piston rods of the hydraulic cylinders are made and assembled so as to increase the reliability and to simplify operation of the device.

With this principal object of the present invention in view, there is provided a device for clamping the adjustment ring of a cone crusher with respect to a support ring screw-threaded thereto, comprising a clamping ring and hydraulic cylinders with spring-actuated piston-rods whose tips are arranged in a groove; one of the surfaces of which is formed by a taper recess of the clamping ring, wherein, according to the invention, the piston rods of the hydraulic cylinders are arranged radially with respect to the axis of the clamping ring having its tapper recess facing outward, the other surface of the groove being formed by the end surface of the support ring, and the clamping ring is screw-threaded onto the adjustment ring.

The present device is advantageous in that the clamping ring, piston-rods contacting the ring and hydraulic cylinders individually are stationary during the adjustment of the crusher setting by rotation of the adjustment ring and, therefore, there is no need for rearrangement of the oil-supplying hoses of the hydraulic cylinders.

The present device is further advantageous in that the hydraulic cylinder portion to deal with during the adjustment faces outward and emerges outside the protective housing secured on the support ring, no removal of the housing is therefore needed to adjust the hydraulic cylinders.

The present device, moreover, has the advantage of simpler design and fewer components.

It is expedient that the check nut be mated with its cylindrical surface with the support ring and be locked with respect to it.

This ensures an even upthrust over the entire circumference of the threads, eliminates misalignment in the threaded joint, and makes it possible to release partially the wedging force with no need for a precise dosage of the oil pressure in the hydraulic cylinders.

It is also practical that the hydraulic cylinders be mounted on the support ring.

Such structural arrangement reduces the possibility of damage of the hydraulic cylinders when carrying out assembling and repair works are kept to a minimum, since it is rather infrequent that the support ring needs dismantling.

It is also advisable that the tips be mounted movably and vertically with respect to the piston rods.

In such an embodiment, the piston rods are completely released from deforming forces resulting from an inadequate matching of parts to be mated and which also occurs when adjusting the crusher setting.

BRIEF DESCRIPTION OF THE DRAWINGS

The present invention will now be explained by the detailed description of the preferred embodiment taken in conjunction with the accompanying drawings, in which.

BEST MODE OF CARRYING OUT THE INVENTION

Figure 1:
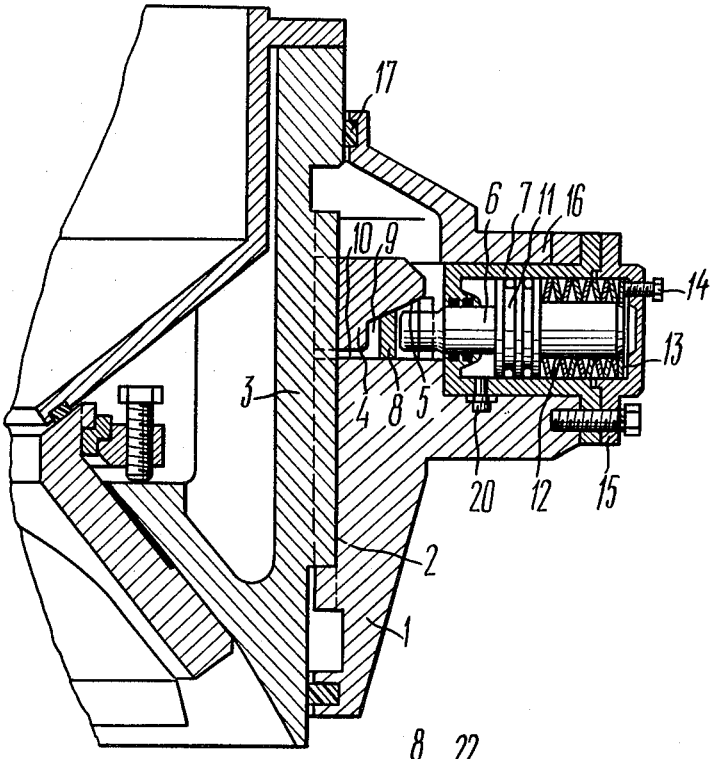
FIG. 1 is a sectional view taken longitudinally and illustrating a device for clamping the adjustment ring of a cone crusher, according to the invention.

Referring to FIG. 1, the device for clamping the adjustment ring of a cone crusher having a support ring 1 screw-threaded by means of threads 2 to the adjustment ring 3, comprises a check nut 4 screw-threaded onto the adjustment ring 3 and provided with an outward-facing taper recess 5. Piston rods 6 of hydraulic cylinders 7 are mounted radially with respect to the axis of the check nut 4 and equipped with taper tips 8 arranged in a groove 9 formed by the taper recess 5 and the end surface 10 of the support ring 1. The hydraulic cylinders 7 accommodate rams 11 contacting a stack of disk springs 12 resting upon a washer 14 having adjusting screws 13 screwed into a head 15 of the hydraulic cylinders 7. The support ring 1 has a housing 16 secured thereto and provided with a packing 17 to keep dust away from the threads 2.

Figure 2:
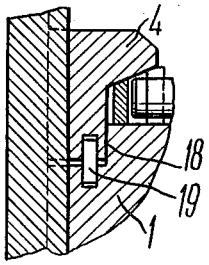
FIG. 2 is a longitudinal section of a modification of the device for clamping the adjustment ring of a cone crusher, according to the invention.

Referring to FIG. 2, there is shown a modification of the device, wherein the check nut 4 is jointed, with its cylindrical surface 18, with the support ring 1 and locked, by means of pins so as not to rotate with respect to it.

It is preferred to secure the hydraulic cylinders 7 on the support ring 1 provided with oil-supplying passages 20.

Figure 3:
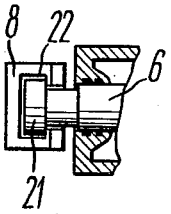
FIG. 3 is a top view of another modification of the device for clamping the adjustment ring of a cone crusher, according to the invention.

Referring to FIG. 3, there is shown another modification, wherein the tips 8 are free to move vertically with respect to the piston rods 6 by means of projections 21 provided in the piston rods 6 and slots 22 provided in the tips 8 and mated thereto.

The device for clamping the adjustment ring, according to the present invention, operates as follows.

Where a need arises to adjust the crusher setting between the liners of the adjusting ring 3 and the breaking head, oil under pressure is supplied to the hydraulic cylinders 7. The rams 11 compress the stack of the springs 12 and reduce the thrust of the tips 8 of the piston rods 6 upon the surface of the recess 5 and the end surface 10 of the groove 9, thereby partially releasing the upthrust in the threaded joint of the adjustment ring 3 with the check nut 4 and support ring 1. After the adjustment ring 3 has been rotated enough to adjust the required setting between the liners of the cones, the oil pressure is released and the stacks of the springs 12 return the rams 11 with the piston rods 6 into their initial position so that the tips 8 wedge out the support ring 1 with respect to the check nut 4 which moves in vertically eliminating play in the threads 2 and developing the required thrust in these to clamp the adjustment ring 3 with respect to the support ring 1.

With the hydraulic cylinders 7 secured on the support ring 1, it becomes possible to avoid damage of these when carrying out re-pair and assembling works.

In the embodiment shown in FIG. 2, the clamping ring 4 is, upon action of the piston rods 6, shifted strictly vertically along the cylindrical surface 18 in the support ring 1, which prevents the clamping ring from misalignment in the threads 2 and provides for a uniform distribution of the thrust over the circumference of the threaded joint. Moreover, the pins 19 exclude casual rotation of check nut 4 together with the adjustment ring 3, no need therewith exists in the precise dosage of the oil pressure in the hydraulic cylinders 7 to provide for the clamp of check nut 4 by means of the friction force alone.

In another embodiment shown in FIG. 3, the tips 8 of the piston rods 6 are capable of self-adjusting in the groove 9 upon the movement of the piston rods 11 and check nut 4, which permits no forces to deform the piston rods 6.

The present device for clamping the adjustment ring of a cone crusher, according to the present invention, makes it possible:

to increase the reliability of clamping the adjustment ring;

to make the operation of the device less labour-consuming;

to cut down lost time when operating the device;

to simplify the design.

The present invention can most advantageously be used in the construction ore mining and dressing industries.

We claim:

1. In a cone crusher including an adjustment ring and a support ring threaded thereto, the improvement comprising a clamp device including a check nut formed with an outwardly facing taper recess, said nut being threaded on said adjustment ring;

hydraulic cylinders having spring-actuated piston rods;

said rods having tips arranged in a groove, said rods being radially disposed relative to said nut; and said groove having a surface delimited by said taper recess of said check nut, another surface of said groove being defined by the end surface of said support ring.

2. The device of claim 1, wherein said check nut is locked by pins to said support ring.

3. The device of claim 2, wherein said hydraulic cylinders are mounted on said support ring.

4. The device of claim 2, wherein said tips are mounted for vertical movement relative to said piston rods.

5. The device of claim 1, wherein said hydraulic cylinders are mounted on said support ring.

6. The device of claim 5, wherein said tips are mounted for vertical movement relative to said piston rods.

7. The device of claim 6, wherein said check nut is locked by pins to said support ring.

8. The device of claim 1, wherein said tips are mounted for vertical movement relative to said piston rods.

* * * * *